US007726755B2

(12) United States Patent
Peng et al.

(10) Patent No.: US 7,726,755 B2
(45) Date of Patent: Jun. 1, 2010

(54) SLIDE RAIL ASSEMBLY

(75) Inventors: Wen-Tang Peng, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 199 days.

(21) Appl. No.: 11/770,754

(22) Filed: Jun. 29, 2007

(65) Prior Publication Data

US 2008/0124009 A1 May 29, 2008

(30) Foreign Application Priority Data

Nov. 29, 2006 (CN) ..... 2006 1 0201158

(51) Int. Cl.
*A47B 88/00* (2006.01)

(52) U.S. Cl. ..... 312/334.46

(58) Field of Classification Search ..... 312/330.1, 312/334.1, 334.7, 334.8, 334.11, 334.44, 312/334.46, 334.47, 319.1, 333; 384/18, 384/20, 21, 22

See application file for complete search history.

(56) References Cited

U.S. PATENT DOCUMENTS

| | | | | |
|---|---|---|---|---|
| 6,296,338 | B1 * | 10/2001 | Stijns | 312/333 |
| 6,851,774 | B2 * | 2/2005 | Chen et al. | 312/334.47 |
| 6,935,710 | B2 * | 8/2005 | Chen et al. | 312/333 |
| 6,945,619 | B1 * | 9/2005 | Chen et al. | 312/334.47 |
| 7,413,269 | B2 * | 8/2008 | Chen et al. | 312/333 |
| 7,571,968 | B2 * | 8/2009 | Ji et al. | 312/333 |

* cited by examiner

*Primary Examiner*—Janet M Wilkens
*Assistant Examiner*—Dan Rohrhoff
(74) *Attorney, Agent, or Firm*—Frank R. Niranjan

(57) ABSTRACT

An exemplary slide rail assembly includes a first rail having a pair of stop members, a second rail, a first release member and a second release member slidably attached to the second rail, a fixing board attached to the second rail, a pair of actuating members slidably attached to the fixing board, and a clip. The clip includes a pair of arms respectively abutting against the actuating members. The actuating members engage with the stop members to latch the second rail in the first rail in two opposite directions. One actuating member is driven by the first release member to disengage from one stop member so that the second rail is released along one direction. The other actuating member is driven by the second release member to disengage from the other stop member so that the second rail is released along the other direction.

20 Claims, 13 Drawing Sheets

SLIDE RAIL ASSEMBLY

BACKGROUND OF THE INVENTION

1. Field of the Invention

The present invention relates to a slide rail assembly.

2. Description of Related Art

Slide rails are used in a variety of applications, including business furniture, kitchen drawers, electronic racks, and copiers. One type of slide rail is a telescopic slide rail. Telescopic slide rails often comprise two, three, four or more telescoping members. The shape of a slide rail, and the individual members, are determined by design needs. The slides can be frictional, with lubricated members rubbing against each other, or a slide assembly may include roller or ball bearings for easier movement. The members in such assemblies tend to be C-shaped in nature.

A conventional three-section slide rail assembly for a drawer includes a first slide rail (e.g. outer slide rail), a second slide rail (e.g. middle slide rail), and a third slide rail (e.g. inner slide rail). A ball rail is sandwiched between any two of the first slide rail, the second slide rail, and the third slide rail to provide a smooth sliding movement. Moreover, the third slide rail and the second slide rail mount a retaining member and a stop member respectively to prevent the slide rails extending too far. The retaining member is attached to an inner surface of the third slide rail, and provided with an inclined wall. The stop member is mounted to a front end of the second slide rail, and provided with a protrusion. To prevent users from drawing the third slide rail out too far from the second slide rail, the protrusion of the stop member engages with the inclined wall of the retaining member.

Users can draw out a keyboard or a component, which is attached to the third slide rail. Although the engagement of the stop member with the inclined wall avoids the release of the third slide rail from the second slide rail by accident, it cannot prevent the third slide rail retracting into the second slide rail too far by careless force of users. Therefore, it is inconvenient to users for operating the slide rail assembly in use.

Consequently, it is required a slide rail assembly which can latch the two rails in two-directions and selectively release the two rails in different directions.

SUMMARY OF THE INVENTION

In one preferred embodiment, a slide rail assembly includes a first rail having a pair of stop members, a second rail, a first release member and a second release member slidably attached to the second rail, a fixing board attached to the second rail, a pair of actuating members slidably attached to the fixing board, and a clip. The clip includes a pair of arms respectively abutting against the actuating members. The actuating members engage with the stop members to latch the second rail in the first rail in two opposite directions. One actuating member is driven by the first release member to disengage from one stop member so that the second rail is released along one direction. The other actuating member is driven by the second release member to disengage from the other stop member so that the second rail is released along the other direction.

Other advantages and novel features of the present invention will become more apparent from the following detailed description of preferred embodiment when taken in conjunction with the accompanying drawings, in which:

DETAILED DESCRIPTION OF THE INVENTION

Figure 1:
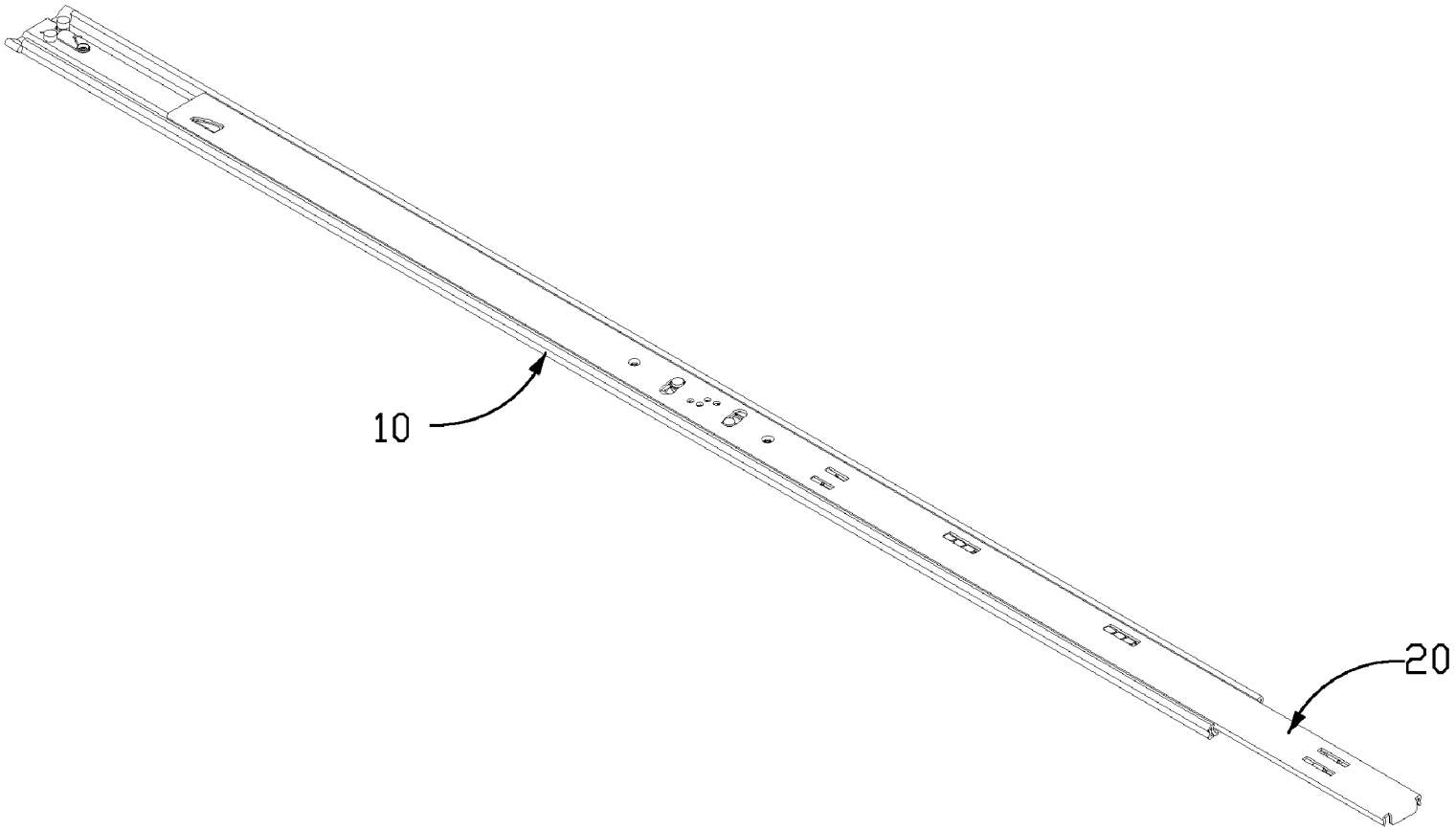
FIG. 1 is an assembled, isometric view of a slide rail assembly according to a preferred embodiment of the present invention.
Figure 2:
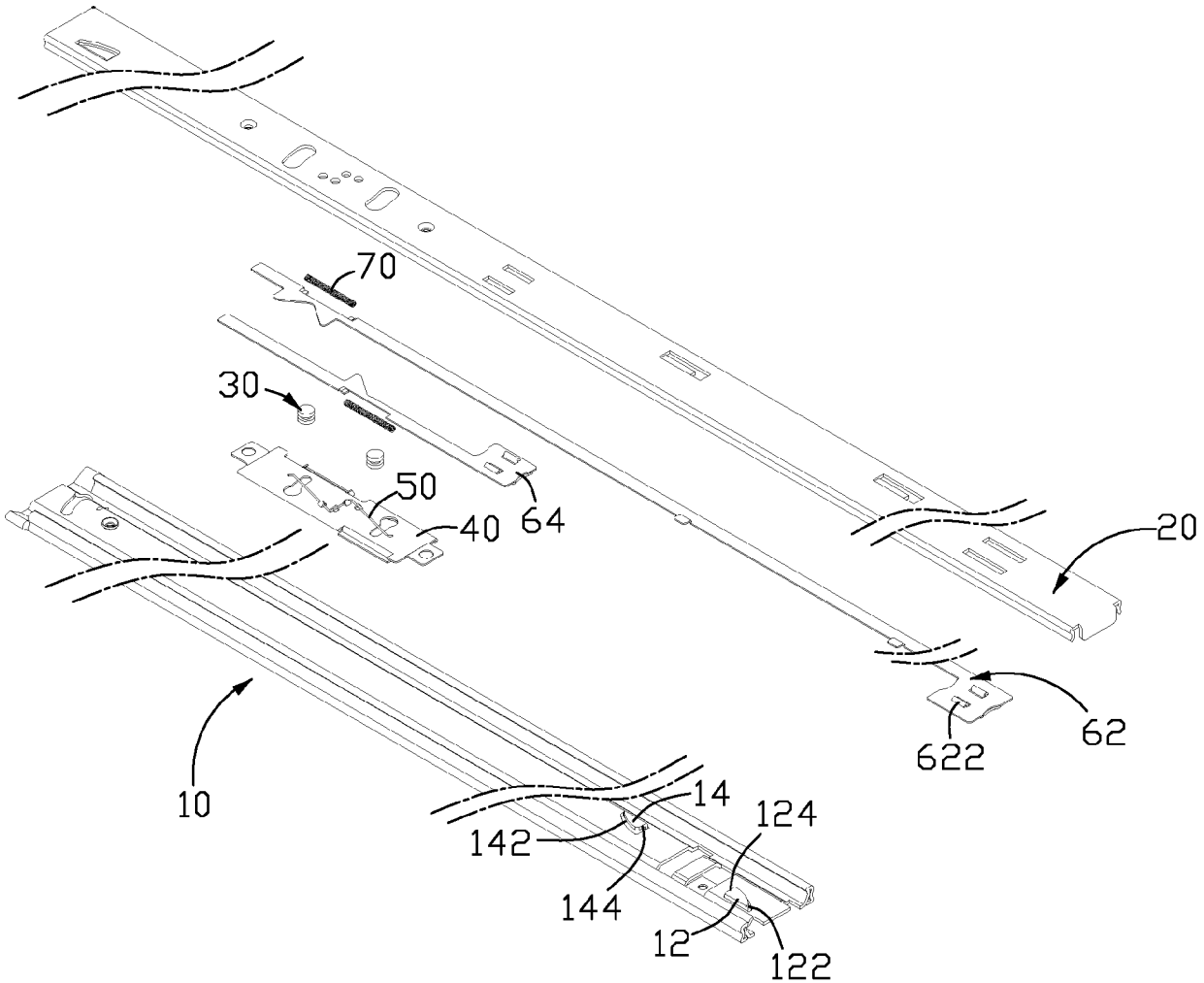
FIGS. 2 and 3 are an exploded, isometric views of FIG. 1, the slide rail assembly including a first rail, a second rail, a pair of actuating members, a clip, a first release member, a second release member, and a fixing board.

Referring to FIGS. 1 and 2, in an embodiment of the invention, a slide rail assembly includes a first rail 10, a second rail 20, a first release member 62, a second release member 64, a fixing board 40, a pair of actuating members 30, a resilient clip 50, and a pair of coil springs 70.

Figure 3:
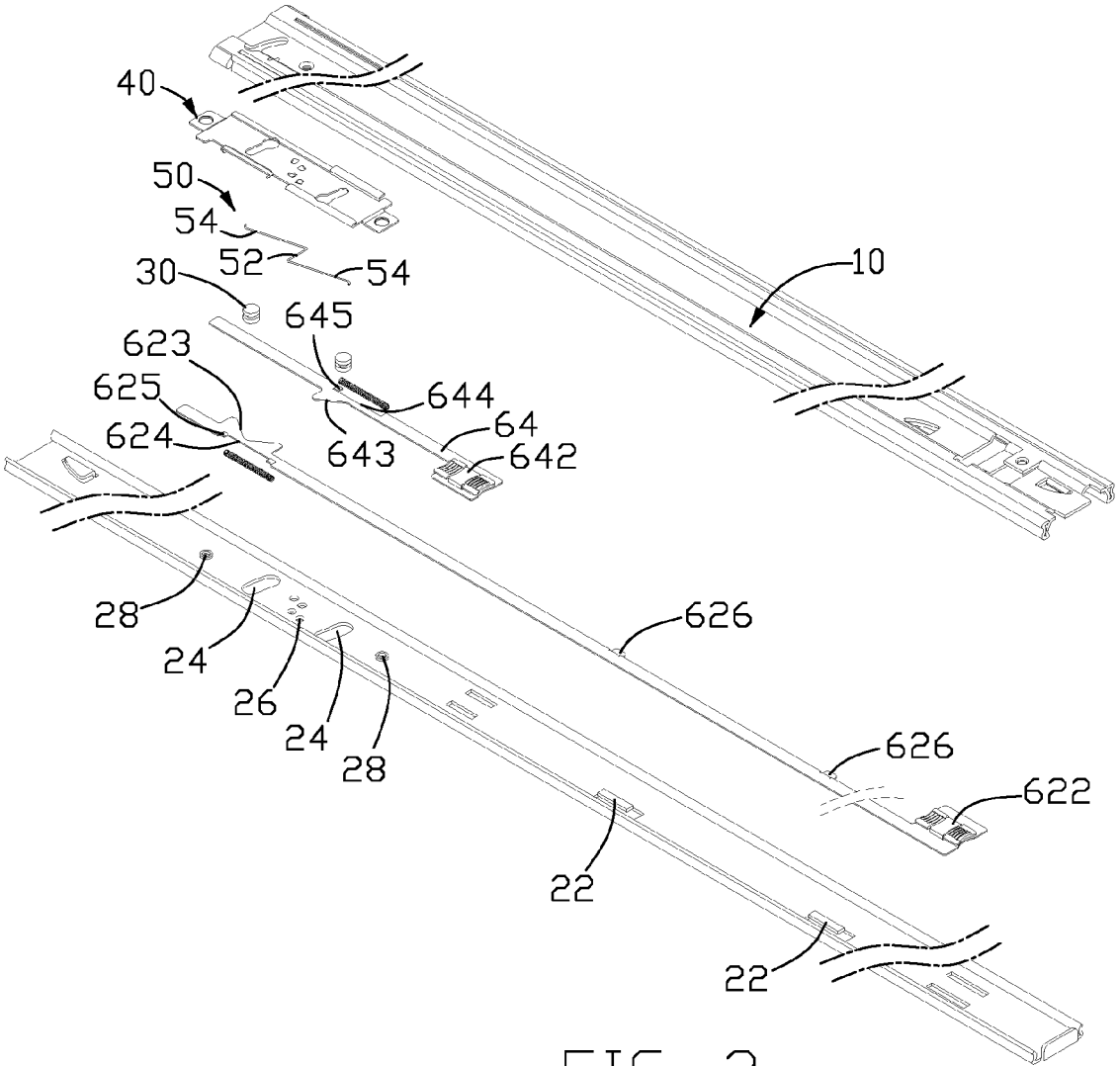

Referring to FIGS. 2 and 3, the first rail 10 includes a first stop member 12, and a second stop member 14 extending from one end thereof. The first stop member 12 and the second stop member 14 are offset from each other in both lateral and longitudinal directions thereof and respectively located near two sides of the first rail 10 in opposite lateral directions. The first stop member 12 includes an arced sliding edge 122, and a straight stop edge 124 in the lateral directions. The second stop member 14 includes an arced sliding edge 142, and a straight stop edge 144 parallel to the stop edge 124.

Referring to FIG. 3, the second rail 20 includes a pair of spaced L-shaped protruding tabs 22 extending along a side thereof in the longitudinal direction of the second rail 20, a pair of spaced elongated slots 24 slantingly defined therein in the lateral direction of the second rail 20, a plurality of apertures 26 defined therein between the slots 24, and a pair of posts 28 extending therefrom each beside an outside of one of the slots 24.

Figure 4:
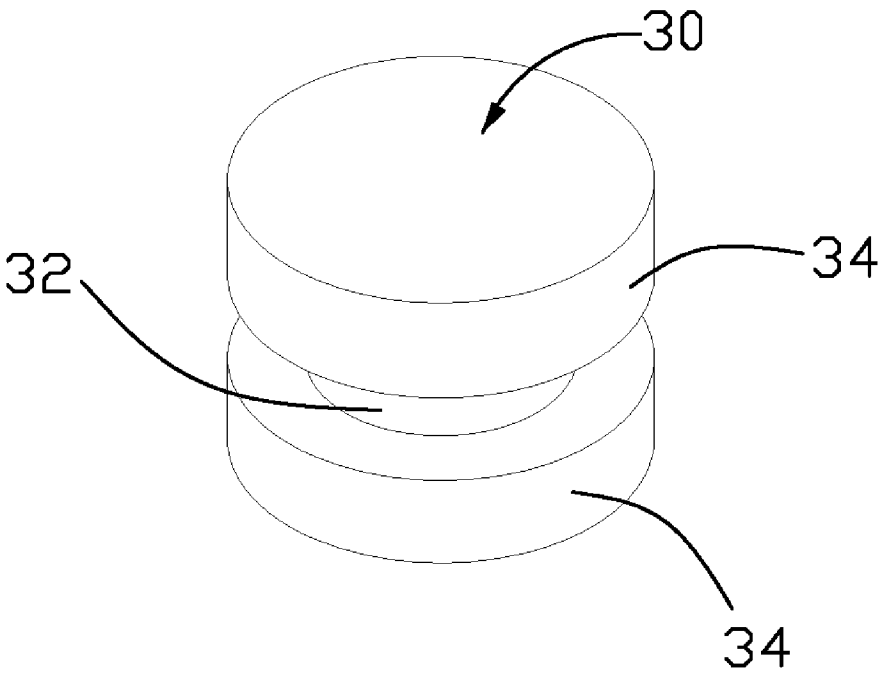
FIG. 4 is an enlarged view of one actuating member of FIG. 2.

Referring to FIG. 4, each of the actuating members 30 includes a neck 32, and a pair of cylinders 34 disposed at two opposite ends of the neck 32 respectively with a larger diameter than that of the neck 32.

Figure 5:
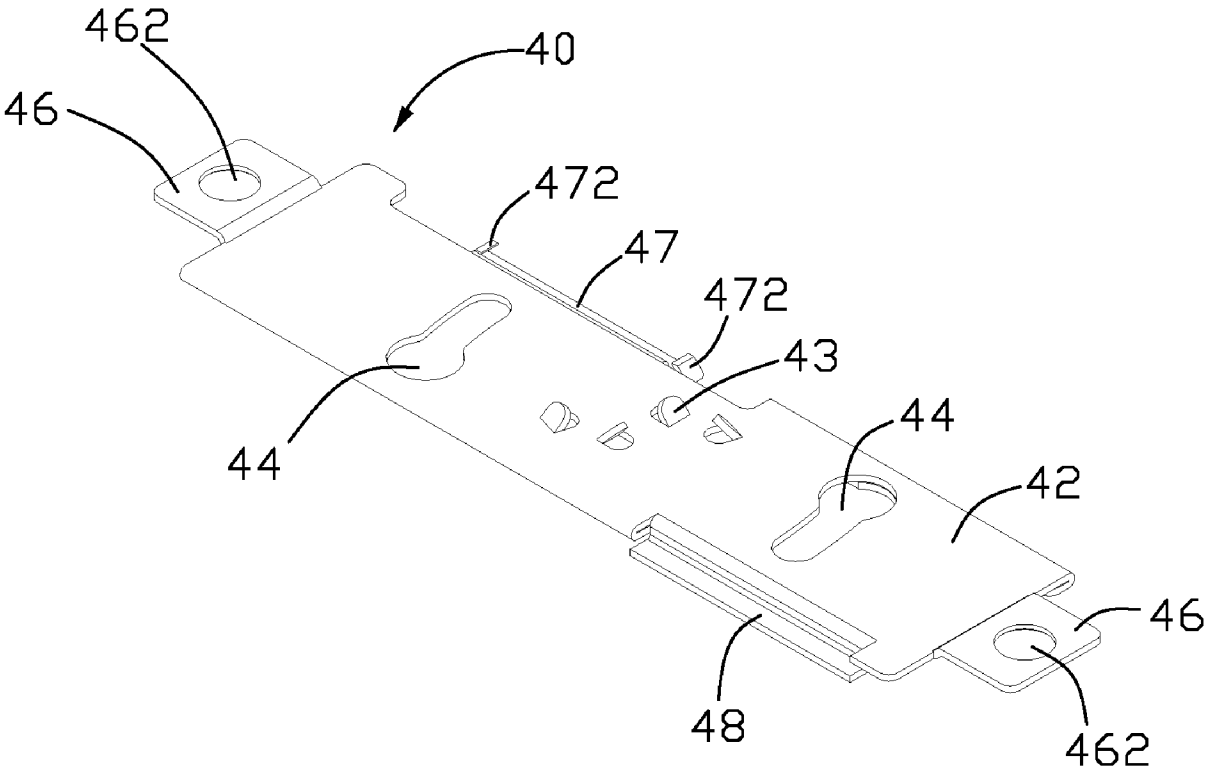
FIG. 5 is an enlarged view of the fixing board of FIG. 2.
Figure 6:
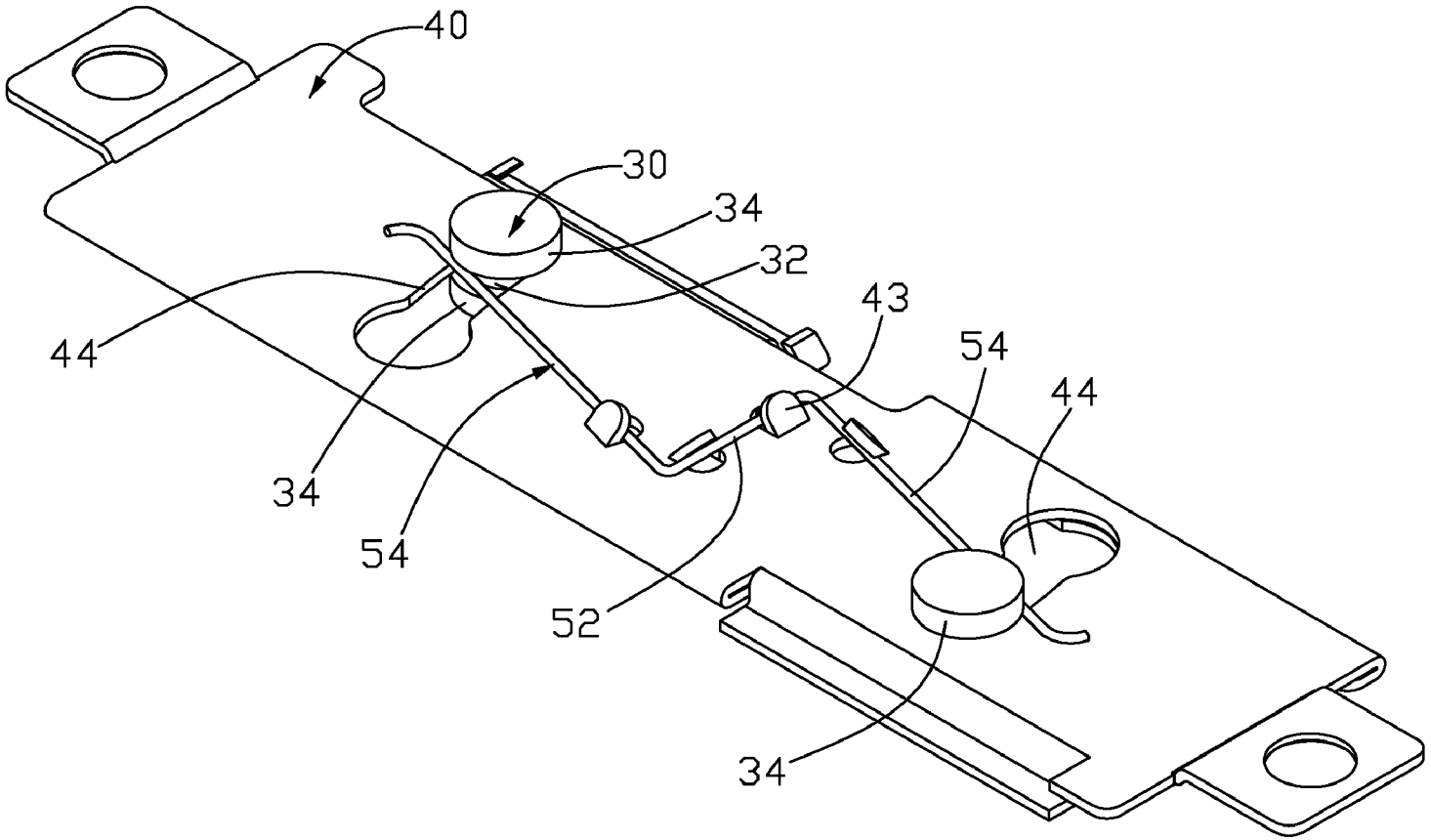
FIG. 6 is an assembled view of the fixing board, the actuating members, and the clip of FIG. 2.

Referring to FIGS. 5 and 6, the fixing board 40 includes a main body 42, and a pair of raised ears 46 each having a through hole 462 extending from two opposite ends of the main body 42 respectively. A pair of keyhole shaped openings 44 each comprising a first end portion with a big size, and a second end portion with a small size, is defined in the main body 42 parallel to each other but with their smaller ends pointed in opposite directions. A plurality of retaining tabs 43 extend out in different directions from the main body 42 between the openings 44 of the main body 42, for engagingly holding the clip 50 thereon. A first retaining portion 47 is formed in the main body 42, at one side of the main body 42. A pair of hooks 472 extends from two opposite ends of the first retaining portion 47 respectively. A second retaining portion 48 is formed in the main body 42, with a stepped configuration, at the other side of the main body 42.

Referring to FIGS. 2 and 3, the first release member 62 is elongated, and includes an operating portion 622 arranged at one end thereof, a driving portion 623 formed at an opposite end thereof, and a plurality of positioning tabs 626 extending therefrom between the operating portion 642 and the driving portion 623, along a side thereof. The driving portion 623 defines a V-shaped cutout, and a first slanting driving edge and a second slanting driving edge are respectively formed at two sides of the V-shaped cutout. The first release member 62 includes a cutout 624 defined therein along the other side thereof, for receiving a coil spring 70 therein. A pair of protruding tabs 625 is formed at two opposite ends of the cutout 624 respectively.

Continuing with FIGS. 2 and 3, the second release member 64 is elongated, and includes an operating portion 642 arranged at one end thereof, a driving portion 643 formed near the operating portion 642, along a side thereof. The driving portion 643 includes a driving edge slanting toward the operating portion 642. The second release member 64 includes a cutout 644 defined therein, along the other side thereof. A protruding tab 645 is formed at an end of the cutout 644 far away from the operating member 642.

The coil springs 70 can be other resilient members.

The clip 50 includes a main portion 52, and a pair of arms 54 generally perpendicularly extending from two ends of the main portion 52 respectively in opposite directions. In this embodiment, the clip 50 is a torsion spring and preferably made by bending a resilient steel wire.

Referring also to FIGS. 5 to 6, in assembly, the actuating members 30 are attached to the fixing board 40, with the actuating members 30 respectively inserted into the first end portions and urged to locate in the second end portions of the openings 44 by the spring 50. The cylinders 34 of the actuating members 30 sandwich an edge of the fixing board 40 adjacent the second end portions of the openings 44. The clip 50 is deformed to be retained between the retaining tabs 43 and the fixing board 40, with two arms 54 respectively biasing the necks 32 of the actuating members 30 toward the second portions of the openings 44.

Figure 7:
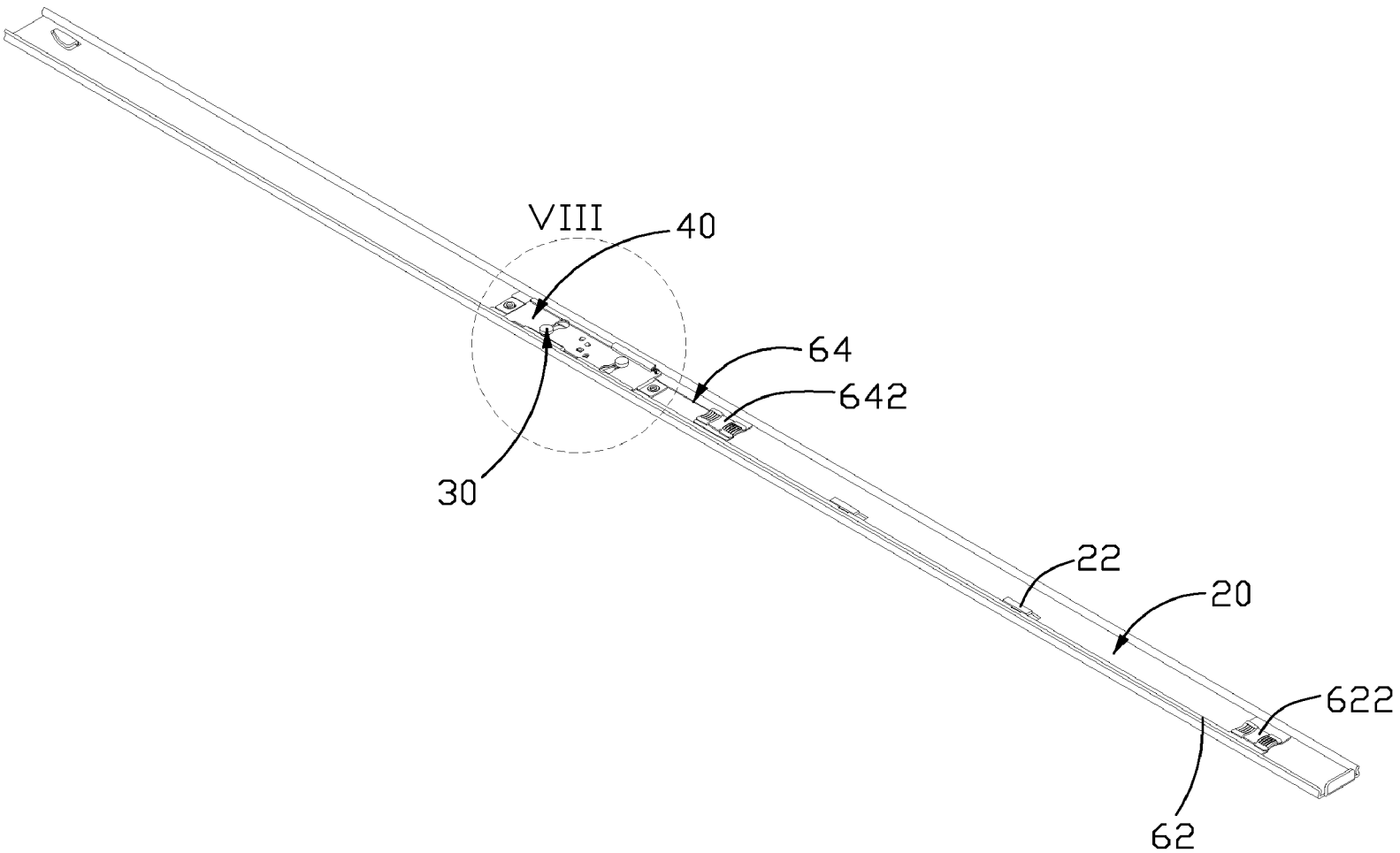
FIG. 7 is an assembled view of the slide rail assembly of FIG. 2 without the first rail attached thereto.
Figure 8:
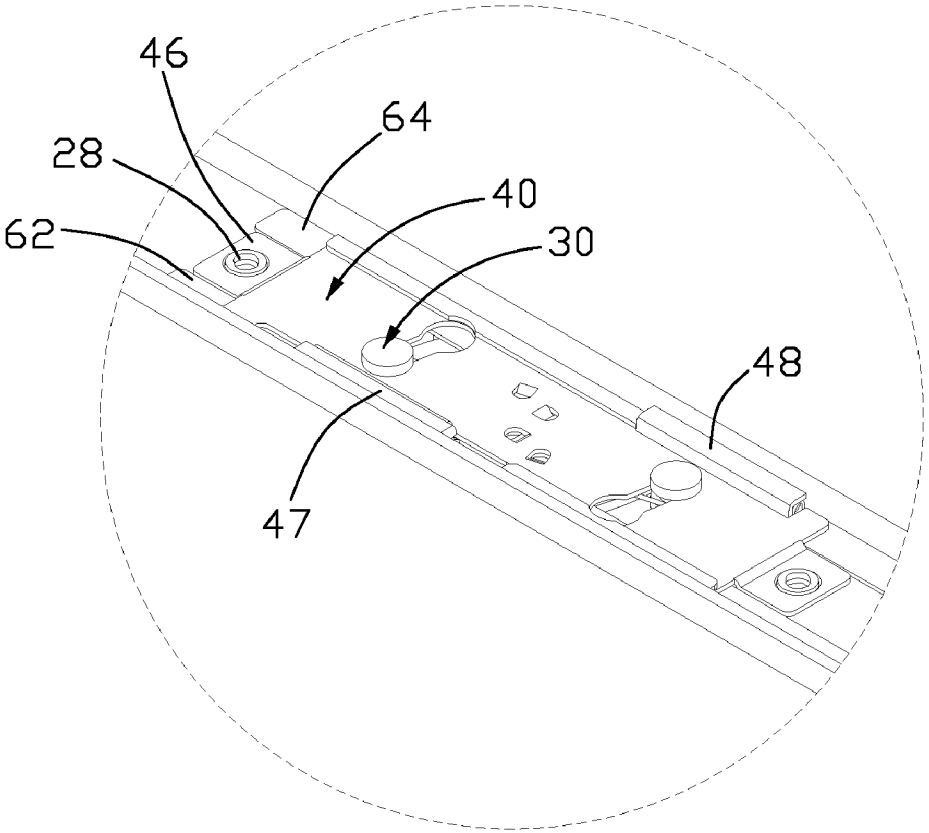
FIG. 8 is an enlarged view of a circled portion VIII of FIG. 7.
Figure 9:
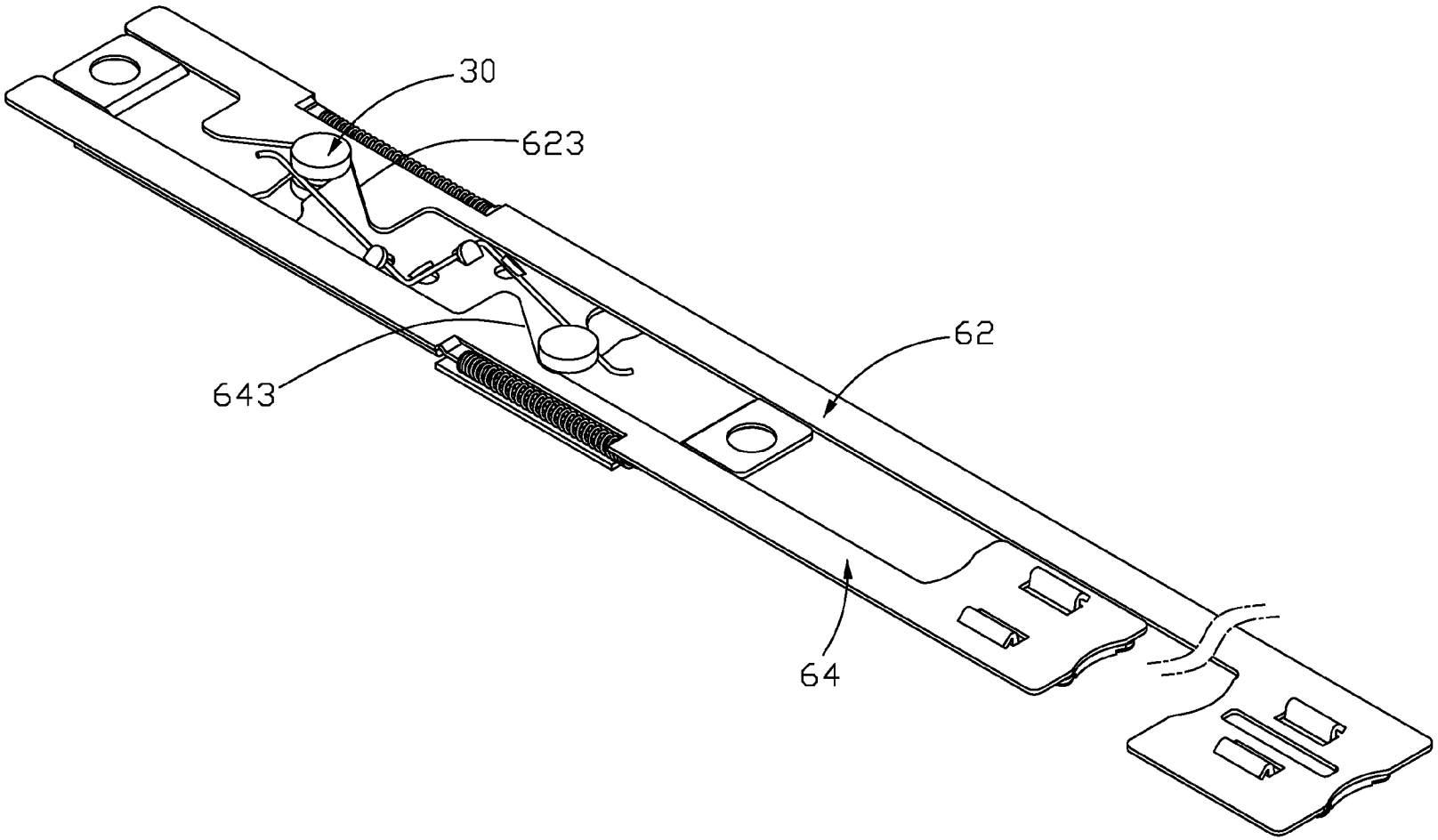
FIG. 9 is an assembly view of the fixing board, the actuating members, the clip, the first release member, and the second release member of FIG. 2.

Referring also to FIGS. 7 to 8, the first release member 62 and the second release member 64 are attached to the second rail 20 respectively along two sides of the second rail 20. The first release member 62 is slidably attached between the positioning tabs 626 and the sidewall of the second rail 20. The positioning tabs 626 are engagable with lower surfaces of the corresponding protruding tabs 22 of the second rail 20 to limit sliding movement distance of the first release member 62 along the longitudinal direction of the second rail 20. The coil springs 70 are respectively depressed to be held in the cutout 624 of the first release member 62 and the cutout 644 of the second release member 64. The protruding tabs 625 of the first release member 62 respectively abut against two distal ends of one coil spring 70. The protruding tab 645 of the second release member 64 abuts against one distal end of the other coil spring 70. The assembled fixing board 40, actuating members 30 and clip 50 is attached to the second rail 20, with the posts 28 riveted in the through holes 462 of the ears 46. Two sides of the fixing board 40 respectively abut the first release member 62 and the second release member 64. The first retaining portion 47 of the fixing board 40 holds one corresponding coil spring 70 therein, with the first retaining portion 47 covering the cutout 624 and pressing the coil spring 70 toward the second rail 20, the hooks 472 engaging with two ends of the coil spring 70. The second retaining portion 48 of the fixing board 40 holds the other corresponding spring 70 therein. The cylinders 34 of the actuating members 30 located close to the second rail 20 are movably received in the slots 24 of the second rail 20. The retaining tabs 43 of the fixing board 40 are received in the apertures 26 of the second rail 20. Referring also to FIG. 9, the first driving edge and the second driving edge of the driving portion 623 of the first release member 62 slidably engage with the cylinder 34 of one actuating member 30. The driving edge of the driving portion 643 of the second release member 64 slidably engages with the cylinder 34 of the other actuating member 30.

Figure 10:
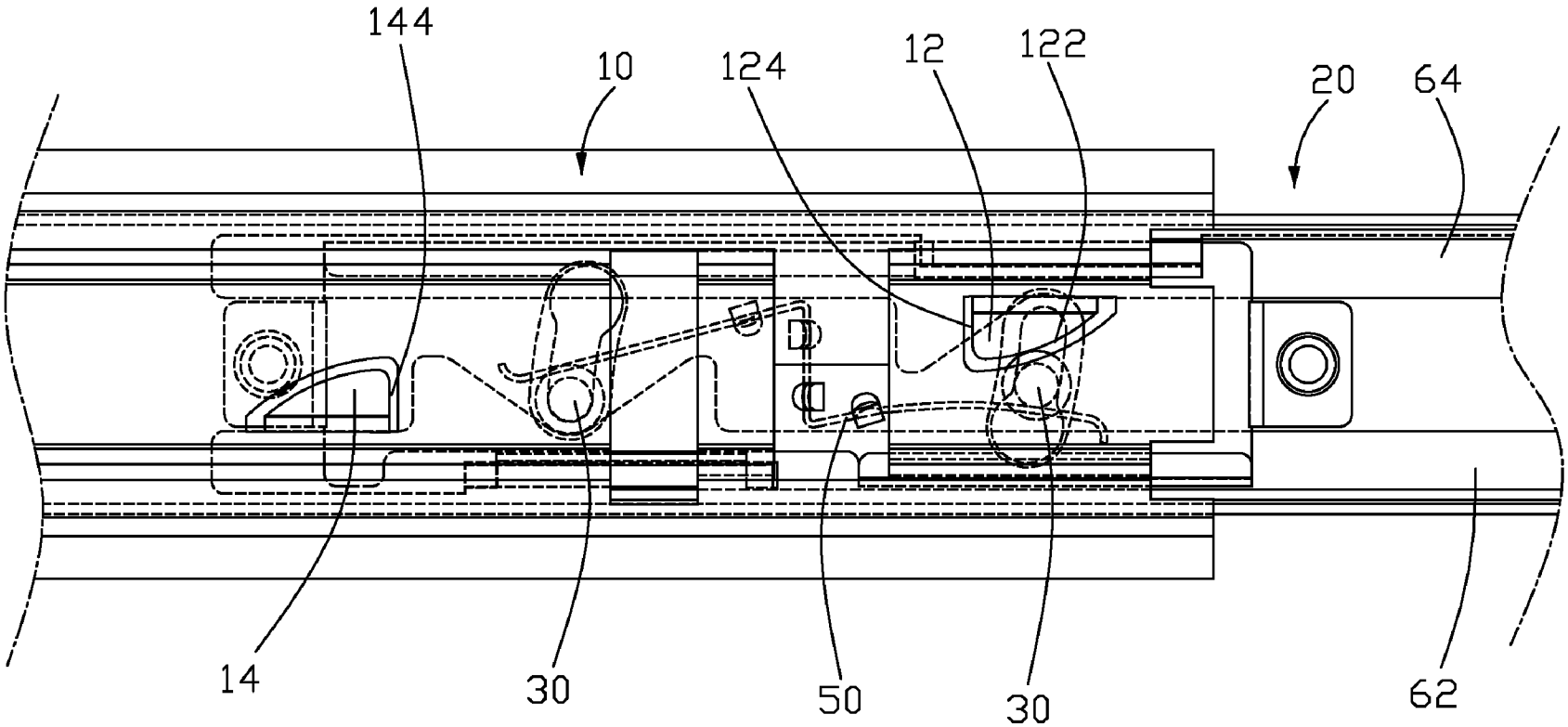
FIGS. 10-13 are lateral views of the slide rail assembly of FIG. 1 in four using states.
Figure 11:
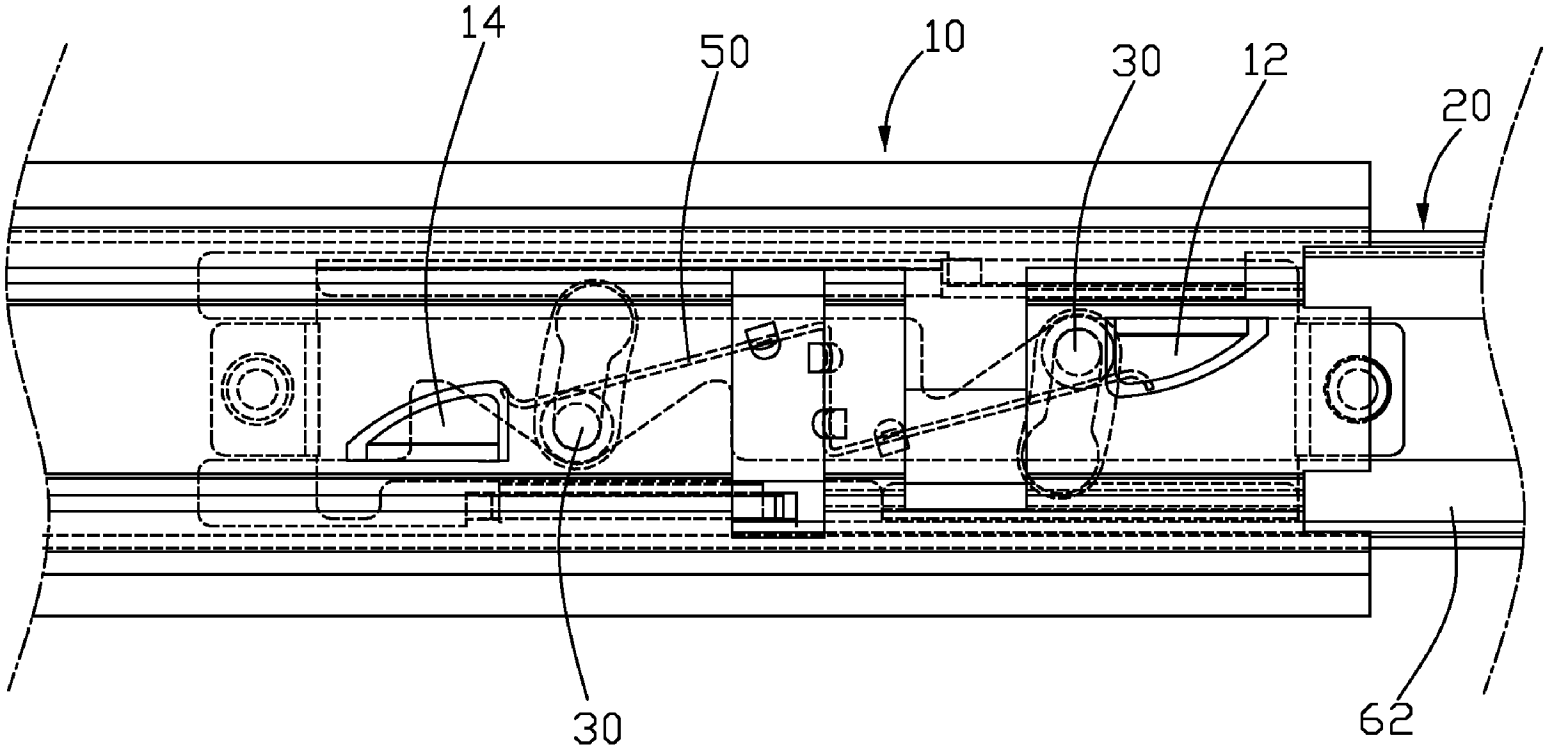

Referring also to FIG. 10, when pushing the second rail 20 to slide into the first rail 10, a left one of the actuating members 30 passes the first stop member 12 without any obstacles and moves toward the second stop member 14 to be blocked by the stop edge 144 of the second stop member 14. At the same time, a right one of the actuating members 30 passes the first stop member 12, with one cylinder 34 thereof sliding along the arced sliding edge 122 to urge the actuating member 30 moving from the second end portion to the first end portion of a right one of the openings 44 of the fixing board 40, and a right arm 54 of the clip 50 is deformed. When the right actuating member 30 passes the sliding edge 122 of the first stop member 12, the right arm 54 of the clip 50 rebounds to urge the right actuating member 30 to move back to the second end portion of the right opening 44. The cylinder 34 of the right actuating member 30 is blocked by the stop edge 124 of the first stop member 12. Thus, the second rail 20 is latched on the first rail 10 by the first stop member 12 and the second stop member 14 in two opposite directions (leftward/inward and rightward/outward), as shown in FIG. 11. At this time, the second rail 20 is at an extended position and the first release member 62 and the second release member 64 are exposed to outside of the first rail 10 for operation.

Figure 12:
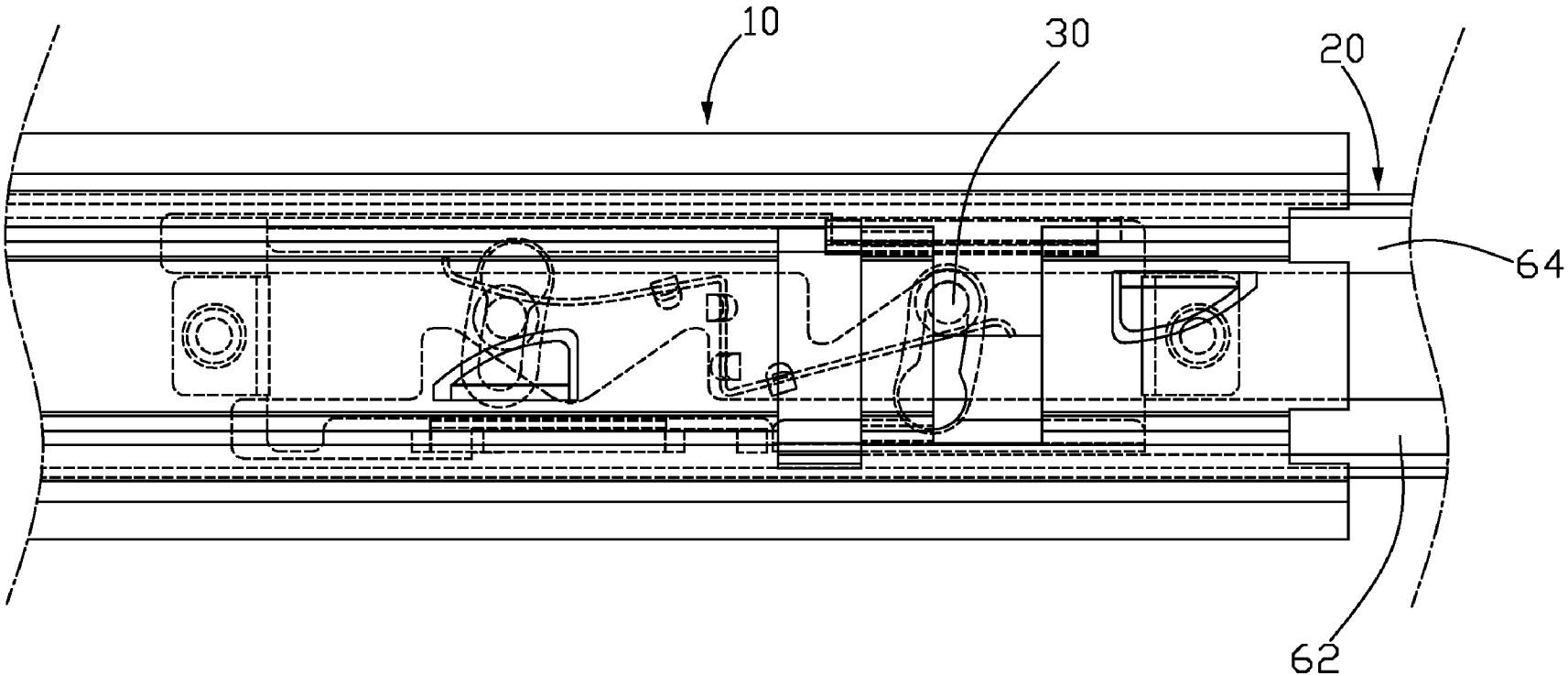

Referring also to FIG. 12, when pushing the second rail 20 back into the first rail 10, the operating portion 622 of the first release member 62 is moved rightward or leftward along the second rail 20 and the corresponding spring 70 retained by the first retaining portion 47 of fixing board 40 is depressed. The first driving edge or the second driving edge of the driving portion 623 of the first release member 62 abuts against one cylinder 34 of the left actuating member 30 to drive the left actuating member 30 to move from the second portion to the first portion of the left opening 44 of the fixing board 40 and deforms the left arm 54 of the clip 50, until the other cylinder 34 of the left actuating member 30 is moved away from the stop edge 144 of the second stop member 14. Thus, the second rail 20 is released and allowed to move leftward but is prevented to move rightward.

Figure 13:
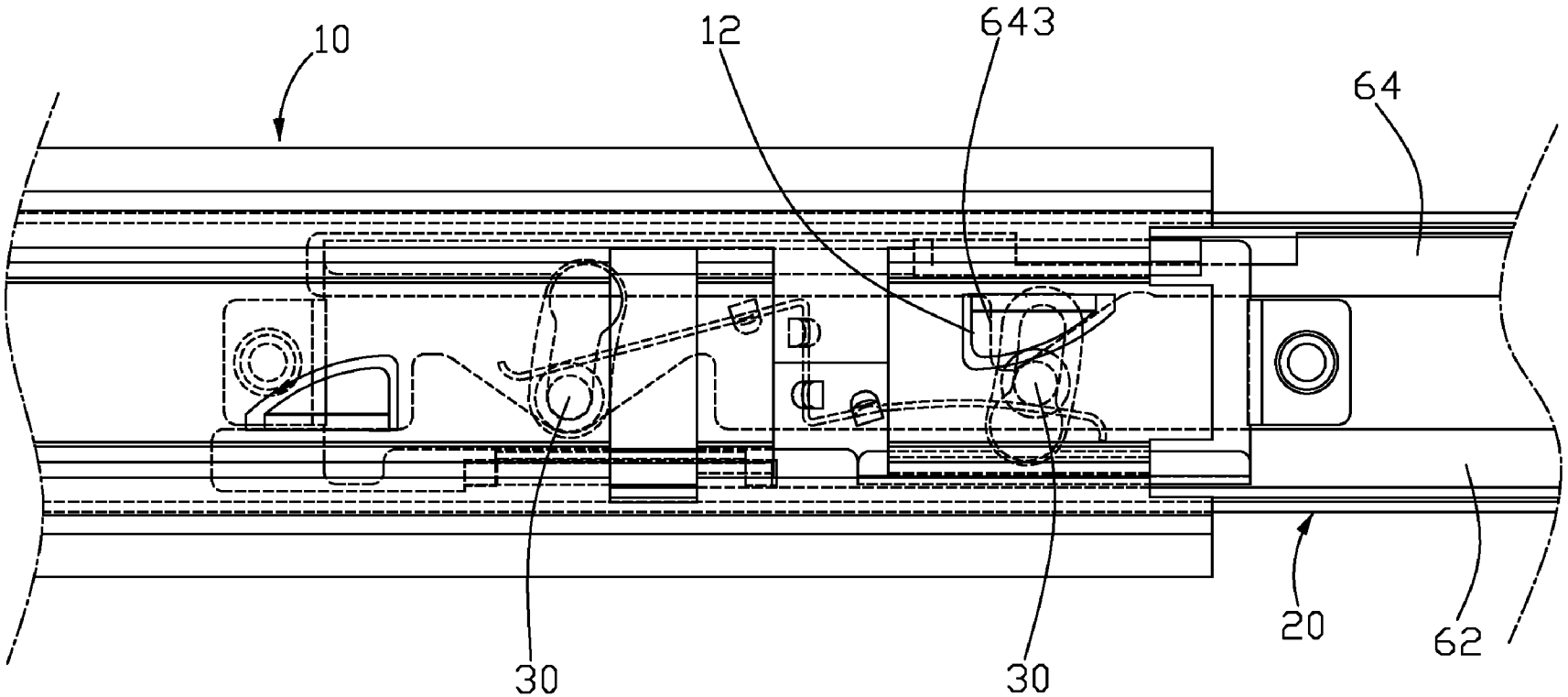

Referring also to FIG. 13, when disassembling the second rail 20 from the first rail 10, the second release member 64 is slidably driven along the second rail 20 rightward and the corresponding spring 70 retained by the second retaining portion 48 of fixing board 40 is depressed. The driving edge of the driving portion 643 of the second release member 64 abuts against one cylinder 34 of the right actuating member 30 to drive the right actuating member 30 to move from the second portion to the first portion of the right opening 44 of the fixing board 40 and deforms the right arm 54 of the clip 50, until the other cylinder 34 of the right actuating member 30 is moved away from the stop edge 124 of the first stop member 12. Thus, the second rail 20 is released and allowable to move rightward and is prevented to move leftward.

In the above described releasing operations, when the first release member 62 or the second release member 64 is released, the coil springs 70 rebound to return the first release member 62 and the second release member 64 to an original position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail assembly comprising:

a first rail comprising a pair of stop members extending therefrom, and offset from each other in both lateral and longitudinal directions thereof;

a second rail slidably attached to the first rail in the longitudinal direction of the first rail;

a first release member slidably attached to the second rail and comprising a driving portion;

a second release member slidably attached to the second rail and comprising a driving portion;

a fixing board immovably attached to the second rail and comprising a pair of openings;

a torsion spring attached to the fixing board and comprising a pair of spring arms; and a pair of actuating members slidably received in the openings of the fixing board and biased by the arms of the torsion spring to slide in the openings, respectively, the actuating members being blocked inward and outward by the stop members respectively to position the second rail in the longitudinal direction of the first rail, wherein one of the first release member and the second release member is slidable along the second rail to allow the driving portion thereof to push one corresponding actuating member to disengage from one corresponding stop member so that the second rail is slidable inward relative to the first rail, and the other one of the first release member and the second release member is slidable along the second rail to allow the driving portion thereof to push the other one corresponding actuating member to disengage from the other one corresponding stop member so that the second rail is slidable outward relative to the first rail.

2. The slide rail assembly as described in claim 1, wherein each of the actuating members comprises a neck engaged in the opening of the fixing board and engaging with the arms of the torsion spring, and a pair of cylinders respectively formed at two opposite ends of the neck respectively engaging with one of the stop members of the first rail and one of the driving portions of the first release member and the second release member.

3. The slide rail assembly as described in claim 2, wherein the driving portion of the first release member comprises a first slanting driving edge, and a second slanting driving edge set at an angle with the first slanting driving edge to selectively engage with the neck of one of the actuating members.

4. The slide rail assembly as described in claim 2, wherein the driving portion of the second release member comprises a slanting driving edge to engage with the neck of another one of the actuating members.

5. The slide rail assembly as described in claim 1, wherein the openings of the fixing board each comprises a first end portion with a big size, and a second end portion with a small size, the actuating members are attached to the fixing board via the first end portions and located in the second end portions by the arms of the torsion spring.

6. The slide rail assembly as described in claim 5, wherein the openings are traversely defined in the fixing plate, the second rail further comprises a pair of slots slantingly defined therein, corresponding to the openings of the fixing board.

7. The slide rail assembly as described in claim 1, wherein the fixing board comprises a pair of ears extending therefrom, a pair of through holes is defined in the ears, the second rail comprises a pair of posts fixedly engaging in the through holes.

8. The slide rail assembly as described in claim 1, wherein the fixing board comprises a first retaining portion, and a second retaining portion respectively formed at two sides thereof, the first release member comprises a cutout with a pair of protruding tabs respectively formed at two ends of the cutout, for retaining a resilient member therein, the second release member comprises a cutout with a protruding tab formed at one end of the cutout, for retaining a resilient member therein.

9. The slide rail assembly as described in claim 1, wherein the torsion spring comprises a main portion, the pair of arms extends in opposite direction from two ends of the main portion, the fixing board comprises a plurality of retaining tabs slantingly extending therefrom to retain the torsion spring.

10. The slide rail assembly as described in claim 9, wherein the second rail further comprises a plurality of apertures defined therein, corresponding to the retaining tabs of the fixing board.

11. The slide rail assembly as described in claim 1, wherein each of the stop members comprises an arced sliding edge, and a straight stop edge, the stop edges of the stop members facing each other while the arced sliding edges opposing each other.

12. A slide rail assembly comprising:

a first rail having a pair of stop members extending therefrom;

a second rail slidably relative to the first rail and comprising a pair of openings, and a spring clip attached thereto with two arms;

a first release member attached to and being slidable relative to the second rail and comprising a driving portion with a pair of angular driving edges;

a fixing board immovably attached to the second rail and comprising a pair of openings corresponding to the pair of openings of the second rail;

a second release member attached to and being slidable relative to the second rail and comprising a driving portion; and a pair of actuating members slidably engaging in the openings of the second rail and the openings of the fixed board and urged by the arms of the spring clip to slide in the openings respectively, two ends of one actuating member respectively engaging with one stop member of the first rail and the driving edges of the first release member, two ends of the other actuating member respectively engaging with the other stop member of the first rail and the driving portion of the second release member;

wherein the first and the second release members are capable of being slid relative to the second rail to move the actuating members to be released from the stop members of the first rail thereby allowing the second rail being released from the first rail and respectively sliding in two opposite directions.

13. The slide rail assembly as described in claim 12, wherein each of the openings of the fixing board comprises a first end portion with a big size, and second end portion with a small size.

14. The slide rail assembly as described in claim 13, wherein the clip is retained on the fixing board and comprises a main portion, and the pair of arms extending in opposite direction from two end of the main portion.

15. The slide rail assembly as described in claim 13, wherein the fixing board comprises a first retaining portion, and a second retaining portion respectively formed at two sides thereof, the first release member comprises a cutout with a pair of protruding tabs formed at two ends of the cutout, for retaining a resilient member, the second release member comprises a cutout with a protruding tab formed at one end of the cutout, for retaining a resilient member.

16. The slide rail assembly as described in claim 12, wherein each of the actuating members comprises a neck engaged in the opening of the fixing board and engaging with the arms of the clip, and a pair of cylinders respectively formed at two opposite ends of the neck and respectively engaging with the stop members of the first rail and the driving portions of the first release member and the second release member.

17. The slide rail assembly as described in claim 12, wherein each of the stop members comprises an arced sliding edge, and straight stop edge.

18. A slide rail assembly comprising:

a first rail having a pair of stop members extending therefrom and offset from each other in both lateral and longitudinal directions;

a second rail slidably attached to the first rail in a longitudinal direction, the second rail providing a pair of openings, a pair of actuating members respectively slidably engaged in the openings in a traverse direction configured for engaging with the stop members to block the first rail from moving relative to the first rail inward and outward in the longitudinal direction, and a spring clip attached to the pair of openings of the second slide rail with two arms configured for maintaining the actuating members engaged with the stop members;

a fixing board immovably attached to the second rail and comprising a pair of openings corresponding to the pair of openings of the second rail;

a first release member slidably attached to one of the first and second rails and comprising a driving portion configured for driving one of the actuating members to disengage from a corresponding one of the stop members to allow the first rail sliding relative to the first rail inward; and a second release member slidably attached to one of the first and second rails and comprising a driving portion configured for driving the other one of the actuating members to disengage from the other corresponding one of the stop members to allow the first rail sliding relative to the first rail outward.

19. The slide rail assembly as described in claim 18, wherein each of the actuating members comprises a pair of cylinders and a neck between the cylinders, each of the actuating members extending through a corresponding opening with the cylinders located at opposite sides of the fixing board, one of the cylinders of each of the actuating members configured for engaging with the corresponding stop member, and the other one of the cylinders of each of the actuating members configured for engaging with one of the driving portions which are located between the second rail and the fixing board.

20. The slide rail assembly as described in claim 18, wherein the first release member and the second release member are slidably attached to the second rail in the longitudinal direction, the first release member being adjacent to one side of the second rail and the second release member being adjacent to an opposite side of the second rail.

* * * * *